US011643925B2

(12) United States Patent
Ross et al.

(10) Patent No.: US 11,643,925 B2
(45) **Date of Patent: *May 9, 2023**

(54) METHOD OF MONITORING A RESERVOIR

(71) Applicant: METROL TECHNOLOGY LIMITED, Aberdeen (GB)

(72) Inventors: Shaun Compton Ross, Aberdeen (GB); Leslie David Jarvis, Stonehaven (GB)

(73) Assignee: METROL TECHNOLOGY LIMITED, Aberdeen (GB)

( * ) Notice: Subject to any disclaimer, the term of this patent is extended or adjusted under 35 U.S.C. 154(b) by 1062 days.

This patent is subject to a terminal disclaimer.

(21) Appl. No.: 16/302,888

(22) PCT Filed: May 26, 2017

(86) PCT No.: PCT/GB2017/051522
§ 371 (c)(1),
(2) Date: Nov. 19, 2018

(87) PCT Pub. No.: WO2017/203292
PCT Pub. Date: Nov. 30, 2017

(65) Prior Publication Data

US 2019/0292905 A1 Sep. 26, 2019

(30) Foreign Application Priority Data

May 26, 2016 (GB) ..... 1609290.0

(51) Int. Cl.
*E21B 33/124* (2006.01)
*E21B 43/116* (2006.01)
(Continued)

(52) U.S. Cl.
CPC ..... *E21B 47/12* (2013.01); *E21B 33/12* (2013.01); *E21B 33/124* (2013.01); *E21B 43/11* (2013.01);
(Continued)

(58) Field of Classification Search
CPC ..... E21B 33/12; E21B 33/124; E21B 43/11; E21B 43/116; E21B 47/06; E21B 47/10; E21B 47/12; E21B 47/07
See application file for complete search history.

(56) References Cited

U.S. PATENT DOCUMENTS 2,619,180 A 11/1952 Smith et al.
3,020,961 A 2/1962 Orr
(Continued)

FOREIGN PATENT DOCUMENTS

CN 203531888 4/2014
DE 102010014415 12/2010
(Continued)

OTHER PUBLICATIONS

UKIPO Search Report dated Nov. 30, 2016 in corresponding GB Application No. GB1609290.0.
(Continued)

*Primary Examiner* — Daniel P Stephenson
(74) *Attorney, Agent, or Firm* — Womble Bond Dickinson (US) LLP

(57) ABSTRACT

A method of monitoring a reservoir comprising setting at least one barrier in a well separating it into upper and lower isolated sections. A perforating gun or other perforating device is provided in the lower isolated section, along with a control mechanism, wireless communication device and a pressure sensor. After the barrier is set, the perforating gun is activated in order to create at least one perforation between the well and a surrounding reservoir. The well, or part of it, is suspended or abandoned but the pressure is still monitored and a wireless, preferably acoustic or electromagnetic, data signal is transmitted from the lower isolated section to above the barrier. Data from the suspended/abandoned part of the well may be used to infer character-
(Continued)

istics of the reservoir so that it may be exploited more appropriately especially through another well.

20 Claims, 4 Drawing Sheets

(51) Int. Cl.

| | |
|---|---|
| ***E21B 47/06*** | (2012.01) |
| ***E21B 47/12*** | (2012.01) |
| ***E21B 47/10*** | (2012.01) |
| ***E21B 43/11*** | (2006.01) |
| ***E21B 33/12*** | (2006.01) |
| ***E21B 47/07*** | (2012.01) |

(52) U.S. Cl.
CPC ..... *E21B 43/116* (2013.01); *E21B 47/06* (2013.01); *E21B 47/07* (2020.05); *E21B 47/10* (2013.01)

(56) References Cited

U.S. PATENT DOCUMENTS

| | | | | |
|---|---|---|---|---|
| 5,394,141 | A | 2/1995 | Soulier | |
| 5,576,703 | A | 11/1996 | MacLeod et al. | |
| 6,095,245 | A * | 8/2000 | Mount | E21B 43/04 166/114 |
| 6,131,462 | A | 10/2000 | EerNisse et al. | |
| 6,173,772 | B1 | 1/2001 | Vaynshteyn | |
| 6,357,525 | B1 | 3/2002 | Langseth et al. | |
| 6,494,616 | B1 | 12/2002 | Tokhtuev et al. | |
| 8,215,164 | B1 | 7/2012 | Hussain et al. | |
| 2002/0020535 | A1 | 2/2002 | Johnson et al. | |
| 2002/0066563 | A1 | 6/2002 | Langseth et al. | |
| 2003/0056952 | A1 | 3/2003 | Stegemeier et al. | |
| 2004/0104029 | A1 | 6/2004 | Martin | |
| 2005/0077086 | A1 | 4/2005 | Vise | |
| 2006/0225881 | A1 | 10/2006 | O'Shaughnessy et al. | |
| 2007/0162235 | A1 | 7/2007 | Zhan et al. | |
| 2007/0236215 | A1 | 10/2007 | Innes et al. | |
| 2008/0066536 | A1 | 3/2008 | Goodwin et al. | |
| 2008/0110644 | A1 | 5/2008 | Howell | |
| 2008/0156482 | A1 | 7/2008 | Gubar et al. | |
| 2009/0229813 | A1 | 9/2009 | Brink et al. | |
| 2011/0158050 | A1 | 6/2011 | Merino et al. | |
| 2011/0174487 | A1 | 7/2011 | Burleson et al. | |
| 2011/0303409 | A1 | 12/2011 | Harrigan et al. | |
| 2012/0085540 | A1 | 4/2012 | Heijnen | |
| 2013/0075109 | A1 | 3/2013 | Frisby et al. | |
| 2013/0133883 | A1 | 5/2013 | Hill | |
| 2013/0299165 | A1 | 11/2013 | Crow | |
| 2014/0041873 | A1 | 2/2014 | Lovik | |
| 2014/0311736 | A1 | 10/2014 | Pipchuk et al. | |
| 2015/0159480 | A1 | 6/2015 | Kalyanaraman et al. | |
| 2015/0233773 | A1 | 8/2015 | Sale et al. | |
| 2015/0292288 | A1 | 10/2015 | Kasperski et al. | |
| 2015/0315895 | A1 | 11/2015 | Patel et al. | |
| 2016/0123133 | A1 | 5/2016 | Leeflang et al. | |
| 2019/0203567 | A1* | 7/2019 | Ross | E21B 37/08 |
| 2019/0257169 | A1* | 8/2019 | Grimsbo | E21B 47/117 |
| 2019/0292905 | A1* | 9/2019 | Ross | E21B 47/10 |
| 2020/0123894 | A1* | 4/2020 | Ross | E21B 47/18 |

FOREIGN PATENT DOCUMENTS

| | | |
|---|---|---|
| EP | 2192262 | 6/2010 |
| EP | 2886790 | 6/2015 |
| GB | 2522272 | 7/2015 |
| WO | 200301169 | 1/2003 |
| WO | 2003098176 | 11/2003 |
| WO | 2014022384 | 2/2014 |
| WO | 2014120988 | 8/2014 |
| WO | 2015/065387 | 5/2015 |
| WO | 2015/130785 | 9/2015 |
| WO | 2017203285 | 11/2017 |
| WO | 2017203286 | 11/2017 |
| WO | 2017203287 | 11/2017 |
| WO | 2017203288 | 11/2017 |
| WO | 2017203290 | 11/2017 |
| WO | 2017203291 | 11/2017 |
| WO | 2017203293 | 11/2017 |
| WO | 2017203294 | 11/2017 |
| WO | 2017203295 | 11/2017 |
| WO | 2017203296 | 11/2017 |

OTHER PUBLICATIONS

International Search Report for PCT/GB2017/051522, dated Aug. 2, 2017.
Schlumberger: "WellWatcher Flux, Multizonal reservoir monitoring system", 2016.
Copending International Application No. PCT/GB2017/051515 filed May 26, 2017.
Copending International Application No. PCT/GB2017/051516 filed May 26, 2017.
Copending International Application No. PCT/GB2017/051517 filed May 26, 2017.
Copending International Application No. PCT/GB2017/051518 filed May 26, 2017.
Copending International Application No. PCT/GB2017/051520 filed May 26, 2017.
Copending International Application No. PCT/GB2017/051521 filed May 26, 2017.
Copending International Application No. PCT/GB2017/051523 filed May 26, 2017.
Copending International Application No. PCT/GB2017/051524 filed May 26, 2017.
Copending International Application No. PCT/GB2017/051525 filed May 26, 2017.
Copending International Application No. PCT/GB2017/051526 filed May 26, 2017.
Examination Report for Corresponding Eurasian Application No. 201892747, dated Apr. 15, 2020.
Examination Report for Corresponding Eurasian Application No. 201892747, dated Nov. 16, 2020.
Examination Report for Corresponding Eurasian Application No. 201892747, dated Jun. 3, 2022.
Examination Report for Corresponding Eurasian Application No. 201892717, dated Sep. 13, 2021.

* cited by examiner

METHOD OF MONITORING A RESERVOIR

CROSS REFERENCE TO RELATED APPLICATIONS

This application is a 35 U.S.C. 371 National Stage of International Application No. PCT/GB2017/051522, titled "METHOD OF MONITORING A RESERVOIR", filed May 26, 2017, which claims priority to GB Application No. 1609290.0, titled "METHOD OF MONITORING A RESERVOIR", filed May 26, 2016, all of which are incorporated by reference herein in their entirety.

BACKGROUND

This invention relates to a method of monitoring a reservoir.

Characteristics of a reservoir may be detected through a first well and, with improved knowledge of the reservoir, appropriate actions on a second well may be determined or optimised.

Testing reservoirs in this way, and assessing for connectivity in a reservoir between wells, is known as connectivity testing such as interference or pulse testing.

A pulse test is where a pressure pulse is induced in a formation at one well/isolated section of the well and detected in another "observing" well or separate isolated section of the same well, and whether and to what extent a pressure wave is detected in the observing well or isolated section, provides useful data regarding the pressure connectivity of the reservoir between the wells/isolated sections. Such information can be useful for a number of reasons, such as to determine the optimum strategy for extracting fluids from the reservoir.

An interference test is similar to a pulse test, though monitors longer term effects at an observation well/isolated section following production (or injection) in a separate well or isolated section. One example is U.S. Pat. No. 3,285,064 where flow rate in a first borehole is changed and pressure in a second borehole is monitored.

It is also useful to know as much about a well and reservoir as possible, and monitor them. This can provide useful information on the reservoir which can assist future recovery from neighbouring wells.

SUMMARY

The inventors of the present invention have developed a new method to gain further understanding of a reservoir.

According to a first aspect of the present invention, there is provided a method of monitoring a reservoir comprising:

in a well with a cross-section, setting at least one barrier in the well, such that pressure and fluid communication are resisted across the entire cross-section of the well thus separating the well into a lower isolated section below the at least one barrier and an upper section above the at least one barrier;

wherein there is provided an apparatus in the lower isolated section, including:

a perforating device;

a control mechanism to control the perforating device, and comprising a wireless communication device configured to receive a wireless control signal for activating the perforating device;

a pressure sensor;

at any time, sending a wireless control signal to the wireless communication device to activate the perforating device, the wireless control signal transmitted in at least one of the following forms: electromagnetic, acoustic, inductively coupled tubulars and coded pressure pulsing;

after the at least one barrier is set, activating the perforating device, in order to create at least one perforation between the well and a surrounding reservoir;

during or after the at least one barrier is set, suspending or abandoning at least a zone adjacent said lower isolated section;

after the perforating device has been activated and after said zone has been suspended or abandoned:

(i) monitoring the pressure in the lower isolated section below the at least one barrier using the pressure sensor; and (ii) sending a wireless data signal including pressure data from below the at least one barrier to above the at least one barrier, using at least one of electromagnetic communication, acoustic communication and inductively coupled tubulars.

Thus in marked contrast to normal procedures of activating a perforating device in order to flow fluid to surface, the inventors of the present invention have provided a barrier in the well before activating the perforating device, so that flow cannot go to surface. Typically therefore, no production occurs from said lower isolated section to the surface, after the barrier has been set, at least until the monitoring and sending wireless data steps have occurred.

It has been found that such a method can elicit useful information on the nature of the reservoir surrounding the well. The pressure, and/or other parameters, may also be monitored before the perforating device is activated and before the zone is suspended/abandoned.

"The at least one barrier" is abbreviated herein to "the barrier".

Whilst the wireless signal could be sent before the barrier is set and the perforating device activated based on a time delay (so they are activated after the barrier has been set); normally the barrier is set before the wireless control signal is sent to the wireless communication device, such that the wireless control signal is sent from above the barrier to the wireless communication device below the barrier to activate the perforating device. Accordingly, for such embodiments, the wireless signal travels through/across/around the barrier.

The perforating device may be activated soon after, or more than a week or more than a month after the barrier has been set/the zone is suspended/abandoned. Indeed, the perforating device may be activated more than six months, more than a year or more than five years afterwards.

The barrier may suspend or abandon the lower isolated section, not necessarily the whole well, such that operations can continue in another section, such as a well test or production of another zone. Alternatively the entire well may suspended or abandoned.

Suspending the zone is where the zone is put into a state where production to the surface does not occur, and where it is to be isolated by the barrier for at least one month, optionally more than three months or more than six months. Indeed, the well may be suspended for longer such as more than a year or more than five years.

Preferably therefore, the barrier is normally a permanent or semi-permanent barrier due to remain in place for at least one month, optionally more than three months or more than six months. Indeed, the barrier may be in place much longer term, such as more than a year or more than five years. Accordingly, no production to the surface would take place over such periods.

Abandoning the well is where it is not intended, or the option is not left open, to return to the well to produce fluids to the surface again. Therefore, the barrier is normally a permanent barrier due to remain in place indefinitely.

Barrier

For certain embodiments, the barrier may comprise a bridge plug or a plugged packer. The barrier may be made up of a number of different parts, which may be spaced apart by for example more than 1 m, more than 10 m, normally less than 500 m, 200 m or less than 50 m. For example a plug may be provided in a central tubing and a packer in an annulus, each respectively blocking a portion of the well such that the entire cross-section of the well resists pressure and fluid communication, effectively preventing pressure connectivity between the surface of the well and the perforating device. Any tubing between such a packer and a plug would then also form part of the barrier. Where the barrier is formed from a central portion (e.g. plug) and an annular portion (e.g. packer), preferably the central portion is at or below the annular portion.

The barrier may comprise or consist of a column of cement, such as a column having a height of at least 2 m or at least 10 m, at least 50 m, 200-500 m and perhaps up to 1000 m or even more. A short cement barrier may be preferred for zonal isolation, whereas longer cement barriers are typically used for well isolation.

An outside of the barrier may engage with an inner face of casing or wellbore in the well.

The barrier is normally at least 100 m or 300 m below the surface of the well.

The apparatus may hang off the barrier.

The barrier may comprise a valve in a closed position. For certain embodiments, the zone is suspended or abandoned by closing a valve to create a barrier, the perforating device is activated, and at a later time, a plug and/or a column of cement may be added to the barrier.

The barrier once set, whether for example a valve or a plug, is normally fixed in position in the well and does not move with respect to an outer casing or borehole.

Second Barrier

The barrier may be a first barrier and a second barrier may be provided, also above the perforating device, such that the second barrier resists pressure and fluid communication across the entire cross-section of the well, thus isolating a section of the well therebelow.

As with the first barrier, the second barrier may comprise a bridge plug or a plugged packer. For certain embodiments, it may comprise or consist of cement such as a column having a height of at least 2 m, 10 m, 50 m, 200-500 m and perhaps up to 1000 m or even more.

Optional features as described above for the first barrier are independent, optional features for the second barrier and are not repeated here for the sake of brevity.

However, the second barrier is less likely to be a valve and more likely to be a static barrier, such as a bridge plug or a lock mandrel.

The second barrier may be above or below the first barrier—normally it is above the first barrier.

Often, it is a requirement to suspend or abandon wells to have two independent barriers in place. For certain embodiments, the perforating device can be activated before the second barrier is in place. Rig time can be saved since the perforating operation could take place concurrently with other well activities such as testing another section/zone. In other embodiments, the perforating device is activated after the second barrier is in place.

In addition to casing, for certain embodiments, especially those including acoustic communications, a tubular may extend from the first and/or second barrier towards the surface of the well. For other embodiments, such as those using EM communication, this may not be necessary.

The second barrier may include a column of cement,

The monitoring step may be undertaken before and/or after the second barrier is set, optionally with a cement column in place above the first barrier.

Container

The apparatus in preferred embodiments of the present invention include a container, and the method includes causing fluid movement through an aperture between an inside and an outside of the container. The direction of fluid movement is preferably from outside the container to inside the container though it can be utilised in the reverse direction.

The fluid movement between the inside and outside of the container can take place before, during and/or after the activation of the perforating device. Indeed, it may be delayed for more than an hour, more than a week, more than one month, optionally more than one year or more than five years after the perforating device has been activated. For example, it may be activated when work is being undertaken on a nearby well.

The apparatus may be elongate in shape. It may be in the form of a pipe. It is normally cylindrical in shape.

Whilst the size of the container can vary, depending on the nature of the well, typically the container may have a volume of at least 5 litres (l) or at least 50 l, optionally at least 100 l. The container may have a volume of at most 3000 l, normally at most 1500 l, optionally at most 500 l.

Thus the apparatus may comprise a pipe/tubular (or a sub in part of a pipe/tubular) housing a container and other components, or indeed, the container may be made up of tubulars, such as tubing or drill pipe joined together. The tubulars may comprise joints each with a length of from 3 m to 14 m, generally 8 m to 12 m, and nominal external diameters of from 2⅜" (or 2⅞") to 7".

The aperture allowing fluid movement between an inside and an outside of the container may be a pre-existing aperture or "port" or may be created in situ, for example by a perforating device.

The aperture provides a cross-sectional area for pressure and fluid communication. Said area may be least 0.1 $cm^2$, optionally at least 0.25 $cm^2$, or at least 1 $cm^2$. The cross-sectional area may be at most 150 $cm^2$ or at most 25 $cm^2$, or at most 5 $cm^2$, optionally at most 2 $cm^2$.

In the first instance, a control device controls the aperture. As an alternative, the container comprises a housing for the perforating device, and the aperture is created by the activation of the (or a different) perforating device. Oftentimes, the perforating device includes at least one shaped charge.

There may be less than ten apertures, or less than five apertures.

Outside the container is generally the surrounding portion of the well. The surrounding portion of the well, is the portion of the well surrounding the apparatus, especially outside the aperture, immediately before the control device is moved in response to the control signal or the aperture created by the or a perforating device.

Entry or egress into or from the container is referred to as "fluid movement".

Control Device

The control device may comprise a mechanical valve assembly, a pump and/or a latch assembly. The control device normally responds to wireless signals via the, or a separate, wireless communication device. The control device may or may not be provided at the aperture. For embodiments with a control device and a pre-existing aperture, the control device may be moved in response to the control signal, at least 2 minutes before and/or at least 2 minutes after, any perforating device activation. It may be at least 10 minutes before and/or after any perforating device activation. Their independent control can elicit useful information between perforating device activating and the control device activating.

The control device may be adapted to close the aperture in a first position, and open the aperture in a second position. Thus, normally, in the first position the control device seals said inside of the container from said outside of the container, and normally, in the second position, the control device allows fluid entry to/from the container. Thus, in the second position, pressure and fluid communication may be allowed between said inside of the container and said outside of the container.

The control device may move again to the position in which it started, or to a further position, which may be a further open or further closed or partially open/closed position. This is normally in response to a further control signal being received. Optionally therefore the control device can move again to resist fluid movement between the container and the outside of the container. For example, flow rate can be stopped or started again or changed, and optionally this may be part-controlled in response to a parameter or time delay. Normally the control device in an open second position remains connected to the apparatus.

The control device may be closed before any pressure differential between the container and the outside of the container has balanced. The remaining pressure differential may optionally be utilised at a later time. Thus the procedure of moving the control device to allow or resist fluid movement can be repeated at a later time.

The control device may be at one end of the apparatus. However it may be in its central body. One or more may be provided at different positions.

The control mechanism may be configured to move the control device to selectively allow or resist fluid movement to/from at least a portion of the container when a certain condition is met, e.g. when a certain pressure is reached e.g. 2000 psi or after a time delay. Thus the control signal causing the response of moving the control device, may be conditional on certain parameters, and different control signals can be sent depending on suitable parameters for the particular well conditions.

Valve

Thus the control device may comprise a mechanical valve assembly having a valve member adapted to move to selectively allow or resist fluid movement between at least a portion of the container and the outside of the container, via the aperture.

The valve member can be controlled directly or indirectly. In certain embodiments, the valve member is driven directly by the control mechanism though normally a separate, second, control mechanism is provided to control the valve member. It may be controlled electro-mechanically or electro-hydraulically via porting. In other embodiments the valve is controlled indirectly by, for example, movement of a piston causing the valve to move.

The mechanical valve assembly may comprise a solid valve member. The mechanical valve assembly normally has an inlet, a valve seat and a sealing mechanism. The seat and sealing mechanism may comprise a single component (e.g. pinch valve, or mechanically ruptured disc).

Piston, needle and sleeve valve assemblies are preferred.

The valve member may be actuated by at least one of a (i) motor & gear, (ii) spring, (iii) pressure differential, (iv) solenoid and (v) lead screw.

Differential Pressure Driven

A variety of different driving forces can cause fluid movement through the aperture such as a pressure differential between the inside and outside of the container, and/or a pump.

Before fluid movement, the pressure inside the container and outside the container may be different, especially lower inside the container compared to outside the container. This pressure difference is more than momentary, it is normally for at least one minute and usually longer.

Thus when an aperture is created, or a control device activated to allow communication through a pre-existing aperture, fluid moves from the higher pressure area to the lower pressure area.

An underbalanced container (having a pressure less than the outside of the container/surrounding portion of the well) is especially preferred. Normally at least 5 litres of fluid is drawn into the container optionally at least 50 l, or at least 100 l (other containers, such as overbalanced containers, can have a similar amount of fluid movement through the aperture). This can remediate formation damage, that is at least partially unblock any blocked portions and/or clear portions of the well and/or surrounding formation; often sufficient to improve pressure connectivity between the well and formation. The inventors of the present invention have recognised that effective testing and/or other well operations can be compromised by pores or other areas being blocked and that knowledge of the effectiveness of unblocking these areas is useful. These blockages may be caused by kill fluid, well debris, mud filter cake, lost circulation material, or perforation debris. Thus 'debris' may include perforation debris and/or formation damage such as filter cake.

The container normally comprises gas for example, at least 85 vol % gas, such as nitrogen, carbon dioxide, or air. In one embodiment, fluid can be sealed in at least a portion (for example more than 50 vol %) of the container at atmospheric pressure before being deployed, and then the apparatus deployed in the well (which has a higher downhole pressure). Thus, the pressure in said portion of the container which has a pressure less than the outside of the container may be, before fluid movement, in the range of 14 to 25 psi, that is normal atmospheric pressure which has sometimes increased with the higher temperatures in the well. Alternatively, the container may be effectively evacuated, that is at a pressure of less than 14 psi, optionally less than 10 psi.

The pressure difference between the inside of the container with a reduced pressure and said outside of the container before fluid movement is allowed may be at least 100 psi, or at least 500 psi, preferably at least 1000 psi.

Pump Driven

Alternatively or additionally, the control device may comprise an electrical pump to cause fluid movement through the aperture between the inside and outside of the container. The pump may be provided at the aperture. Optionally the pump is configured to pump fluid from outside the container to inside the container. Alternatively, the pump is operated to pump fluid from within the container to the surrounding portion of the well. Often this is at least one litre or more than five litres of fluid which has been added to the container at the surface before the apparatus is run into the well. This fluid may be used to treat the well/reservoir.

The electrical pump is preferably a positive displacement pump such as a piston pump, gear type pump, screw pump, diaphragm, lobe pump; especially a piston or gear pump. Alternatively the pump may be a velocity pump such as a centrifugal pump.

The pump may be operable to pumps fluids at a rate of 0.01 cc/s to 20 cc/s.

The pump operation or rate can be controlled in response to a further control signal being received by the or a separate wireless communication device (or this may be an instruction in the original signal).

Other Control Devices

The control device may comprise a latch assembly which in turn controls a floating piston—it can hold the floating piston in place against action of other forces (e.g. well pressure) and is released/moved in response to an instruction from a controller to allow fluid movement through the aperture.

The aperture may include a non-return valve which can resist fluid movement therethrough.

Choke

The apparatus may comprise a choke.

The choke may be integrated with the control device or it may be in a flowpath comprising the aperture and the control device.

Said cross-sectional area may comprise a filter.

The valve member may function as the choke, optionally an adjustable choke which can be varied in situ or it may be a fixed choke.

Thus the size of the cross-sectional area for fluid movement may be small enough, for example 0.1-0.25 $cm^2$, which effectively chokes the fluid movement.

Floating Piston

A floating piston may be provided in the container, such as to separate one fluid from another. For example, on one side of a floating piston, fluid to be released can be provided, and on another side, a gas at a higher pressure than the surrounding well can be provided to drive the fluid out when a control device allows pressure and fluid communication between the container and the surrounding well.

Certain embodiments have the container and said floating piston, without additional chambers. However, for other embodiments, a portion of the container can be pressure balanced (optionally selectively) with the surrounding portion of the well. A pump can then be used to draw in or expel fluid from the pressure balanced container; or the pressure charged and then held until the surrounding portion of the well is at a different pressure. For certain other embodiments, the container may include two sections separated by the control device, one being a fluid chamber and the second chamber being a dump chamber, drive chamber or pressure balancing chamber. Where there is a pressure difference between the inside and outside of the container, the second chamber is normally the portion of the container having such a pressure difference.

The control device can control fluid movement between the fluid chamber and the second chamber.

The floating piston can further separate two sections in the fluid chamber, one section in fluid communication with the aperture and another section on an opposite side of the floating piston, in communication with the second chamber.

Thus one side of the floating piston may be exposed to the well pressure via the aperture. A fluid, such as oil, may be provided in the fluid chamber on the second chamber side of the floating piston.

For embodiments with a second chamber, a variety of embodiments can be provided. The second chamber may be a dump chamber with a pressure less than that of the surrounding portion of the well, whilst the control device comprises a valve, thus indirectly allowing or resisting fluids to be drawn into the fluid chamber section of the container.

Alternatively, the second chamber may be a drive chamber having a pressure higher than that of the surrounding portion of the well. In which case, the control device optionally comprising a valve can allow or resist fluids to be expelled from the fluid chamber section of the container.

In either case, for these embodiments, since the control device is between the fluid chamber and the second chamber, it indirectly controls fluid movement through the aperture in the fluid chamber.

Alternatively, the second chamber may be a pressure balancing chamber and the control device comprising a pump that draws fluid in, or drives fluids out, of the fluid chamber section, aided by a pressure balancing port in the pressure balancing chamber.

Thus in response to the control signal the control device can allow fluid movement between the container (fluid chamber section) and an outside of the container, for example the well, to draw in or expel fluids therefrom.

A non-return valve may be provided in the aperture.

The second chamber may have at least 90% of the volume of that of the fluid chamber although for certain embodiments, the second chamber has a volume greater than the volume of the fluid chamber to avoid or mitigate pressure build-up within the second chamber and hence achieve a more uniform flow rate into the fluid chamber.

Normally the floating piston has a dynamic seal against an inside of the container.

Secondary Containers

In addition to the container (sometimes referred to below as a 'primary container') there may be one or more secondary containers, optionally each with respective control devices controlling fluid communication between the inside of the respective secondary container and the outside of that container. This may be, for example, a surrounding portion of the well, or another portion of the apparatus or the formation.

Thus there may be one, two, three or more than three secondary containers. The further control devices for the secondary containers may or may not move in response to a control signal, but may instead respond based on a parameter or time delay. Each control device for the respective secondary container can be independently operable. A common communication device may be used for sending a control signal to a plurality of control devices.

The containers may have a different internal pressure compared to the pressure outside of the container such as the surrounding portion of the well or the formation. If less than the outside of the container, as described more generally herein, they are referred to as 'underbalanced' and when more than the outside of the container they are referred to as 'overbalanced'.

Thus, a plurality of primary and/or secondary containers or apparatus may be provided each having different functions, one or more containers may be underbalanced, one or more containers overbalanced, or one or more containers controlled by a pump. Underbalanced, overbalanced and/or pump controlled secondary container(s) and associated apertures and control devices may be provided, the secondary container(s) each preferably having a volume of at least five litres and, in use, having a pump and/or a pressure lower/higher than the outside of the container normally for at least one minute, before the control device is activated optionally in response to the control signal. Fluids surrounding the secondary container can thus be drawn in (for underbalanced containers), optionally quickly, or fluids expelled (for overbalanced containers).

This can be useful, for example, to partially clear a filter cake using an underbalanced container, before deploying an acid treatment onto the perforations using the container controlled by a pump.

Alternatively, for a short interval manipulation, a skin barrier could be removed from the interval by acid deployed from an overbalanced container and then the apparatus with an underbalanced container used to draw fluid from the interval.

Fluid from a first chamber within the container can go into another to mix before being released/expelled.

The secondary aperture may include a non-return valve which can resist fluid release from the container.

Other Apparatus Options

In addition to the wireless signal, the apparatus may include pre-programmed sequences of actions, e.g. a valve opening and re-closing, or a change in valve member position; based on parameters e.g. time, pressure detected or not detected or detection of particular fluid or gas. For example, under certain conditions, the apparatus will perform certain steps sequentially—each subsequent step following automatically. This can be beneficial where a delay to wait for a signal to follow on could mitigate the usefulness of the operation.

Normally the aperture is provided on a side face of the apparatus although certain embodiments can have the aperture provided in an end face.

There may be more than one apparatus.

Short Interval

The aperture may be positioned between two portions of a packer element (or two packer elements), and a control device activated in response to the control signal to expose the pressure in the container to the adjacent well/reservoir in order to conduct a short interval procedure. For such embodiments, a perforation is formed between the well and reservoir in the short interval by a or the perforating device.

Often, said two portions are two separate packer elements which are spaced apart to define the short interval. However a single packer element can be used and the aperture and the perforation is provided between two portions of the same packer element, for example a single circular packer element.

The barrier according to the first aspect of the present invention may include one of said portions of the packer elements defining the short interval. Alternatively, the two portions of packer element may be separate to said barrier.

Preferably fluid is drawn from outside the container into the container. Thus such a procedure is preferably performed using an apparatus comprising a pressure within the container that is less than an outside of the container e.g. the reservoir close to the perforation or with a pump which could direct fluid in either direction.

Therefore, the method described herein may be used to conduct an interval injectivity, permeability, well/reservoir treatment, hydraulic fracturing, minfrac or similar test/procedure which may require pressure to be applied between two packer elements. In preferred embodiments, the pressure in the container is released gradually over several seconds (such as 5-10 seconds), or longer (such as 2 minutes-6 hours) or even very slow (such as 1-7 days). Choke functionality is therefore particularly useful.

The packer elements are normally part of (an) overall packer(s), which may be wirelessly controlled. Thus it may be expandable and/or retractable by wireless signals. The overall packer may be an inflatable packer.

The short interval, e.g. the distance between two portions of packer elements, may be less than 30 m, optionally less than 10 m, optionally less than 5 m or less than 2 m, less than 1 m, or less than 0.5 m. These distances are taken from lowermost point of an upper packer element of the (first) packer element, and the uppermost point of a lower packer element of the second packer element. Thus this can limit the volume and so the apparatus is more effective when the aperture is exposed to the limited volume.

For certain embodiments, such a test can provide an initial indication on the reservoir response to an injection/hydraulic fracturing operation, and may reduce the requirement to conduct a larger scale injection/hydraulic fracturing operation.

The method described herein may be used to conduct an interval test, drawdown test, flow test, build-up test or pressure test.

The apparatus may further comprise an exhaust port in fluid communication with the container, the exhaust port being below the second annular sealing device or above the first annular sealing device. A pump may be provided to direct fluid through the exhaust port.

Reduced Well Pressure

Before setting the barrier, lighter fluids may be circulated in the well for example as part of a flow test, or for other reasons. This reduces the pressure in the well because of the reduced hydrostatic head of the lighter fluids. For certain embodiments, the barrier may be set whilst the pressure in the well is reduced in this way to a pressure lower than the reservoir pressure. Therefore the well may be underbalanced with respect to the reservoir at the time of perforating.

An advantage of such embodiments is that when the perforating device is activated the reduced pressure draws more debris away from the perforation(s) in order to enhance the connectivity between the well and the surrounding reservoir.

Often heavy fluid is provided in the well to help control it.

This heavy fluid can lead to poor pressure connectivity through perforations between reservoir and wellbore. Embodiments of the present invention provide the barrier, thus enabling the reservoir to be perforated in a zone without such heavy fluid, thus avoiding contact between the heavy fluid and the perforations.

Sensors

The apparatus may include sensors for fluid analysis including optical fluid analysis, density, water cut and those to determine Gas:Oil Ratio (GOR).

Any other sensors are preferably provided below the barrier and data recovered as described herein for the pressure sensor. Preferably a temperature sensor is also provided. A variety of other sensors may be provided, including acceleration, vibration, torque, movement, motion, radiation, noise, magnetism, corrosion; chemical or radioactive tracer detection; fluid identification such as hydrate, wax and sand production; and fluid properties such as (but not limited to) flow, density, water cut, for example by capacitance and conductivity, pH and viscosity. Furthermore the sensors may be adapted to induce the signal or parameter detected by the incorporation of suitable transmitters and mechanisms. The sensors may also sense the status of other parts of the apparatus or other equipment within the well, for example control device status, such as valve member position.

An array of discrete temperature sensors or a distributed temperature sensor can be provided (for example run in) with the apparatus. Thus they may be below the barrier, or above the barrier or even outside the casing. Preferably therefore it is below the barrier.

These temperature sensors may be contained in a small diameter (e.g. ¼") tubing line and may be connected to a transmitter or transceiver. If required any number of lines containing further arrays of temperature sensors can be provided. This array of temperature sensors and the combined system may be configured to be spaced out so the array of temperature sensors contained within the tubing line may be aligned across the formation, for example the perforations; either for example generally parallel to the well, or in a helix shape.

The array of discrete temperature sensors may be part of the apparatus or separate from it.

The temperature sensors may be electronic sensors or may be a fibre optic cable.

Therefore in this situation the additional temperature sensor array could provide data from the perforation interval (s) and indicate if, for example, perforations are blocked/restricted. The array of temperature sensors in the tubing line can also provide a clear indication of fluid flow, particularly when the apparatus is activated. Thus for example, more information can be gained on the response of the perforations—an upper area of perforations may have been opened and another area remain blocked and this can be deduced by the local temperature along the array of the temperature sensors.

Data may be recovered from the pressure sensor(s), before, during and/or after the perforating device is activated, and before during or after the fluid movement is caused between an inside and an outside of the container.

Recovering data means retrieving the data to the surface.

The data recovered may be real-time/current data and/or historical data.

Data is preferably sent by acoustic and/or electromagnetic signals.

Data may be recovered by a variety of methods. For example it may be transmitted wirelessly in real time or at a later time, optionally in response to an instruction to transmit.

Memory

The apparatus especially the sensor(s), may comprise a memory device which can store data for recovery at a later time. The memory device may also, in certain circumstances, be retrieved and data recovered after retrieval.

The memory device may be part of sensor(s). Where separate, the memory device and sensors may be connected together by any suitable means, optionally wirelessly or physically coupled together by a wire. Inductive coupling is also an option. Short range wireless coupling may be facilitated by EM communication in the VLF range.

The apparatus may be configured to monitor the pressure or other parameters below the barrier for periods of time longer than one week, one month, one year or more than five years.

The memory device may be configured to store information for at least one minute, optionally at least one hour, more optionally at least one week, preferably at least one month, more preferably at least one year or more than five years.

Signals

The wireless control signal is transmitted in at least one of the following forms: electromagnetic, acoustic, inductively coupled tubulars and coded pressure pulsing and references herein to "wireless" relate to said forms, unless where stated otherwise.

The signals may be data or command signals and need not be in the same wireless form. Accordingly, the options set out herein for different types of wireless signals are independently applicable to data and command signals. The control signals can control downhole devices including sensors. Data from sensors may be transmitted in response to a control signal. Moreover data acquisition and/or transmission parameters, such as acquisition and/or transmission rate or resolution, may be varied using suitable control signals.

Coded Pressure Pulses

Where coded pressure pulses are used to activate the perforating device, a firing head of the perforating device may be above or may be below the barrier.

Pressure pulses include methods of communicating from/to within the well/borehole, from/to at least one of a further location within the well/borehole, and the surface of the well/borehole, using positive and/or negative pressure changes, and/or flow rate changes of a fluid in a tubular and/or annular space.

Coded pressure pulses are such pressure pulses where a modulation scheme has been used to encode commands within the pressure or flow rate variations and a transducer is used within the well/borehole to detect and/or generate the variations, and/or an electronic system is used within the well/borehole to encode and/or decode commands. Therefore, pressure pulses used with an in-well/borehole electronic interface are herein defined as coded pressure pulses. An advantage of coded pressure pulses, as defined herein, is that they can be sent to electronic interfaces and may provide greater data rate and/or bandwidth than pressure pulses sent to mechanical interfaces.

Where coded pressure pulses are used to transmit control signals, various modulation schemes may be used to encode control signals such as a pressure change or rate of pressure change, on/off keyed (OOK), pulse position modulation (PPM), pulse width modulation (PWM), frequency shift keying (FSK), pressure shift keying (PSK), amplitude shift keying (ASK), combinations of modulation schemes may also be used, for example, OOK-PPM-PWM. Data rates for coded pressure modulation schemes are generally low, typically less than 10 bps, and may be less than 0.1 bps.

Coded pressure pulses can be induced in static or flowing fluids and may be detected by directly or indirectly measuring changes in pressure and/or flow rate. Fluids include liquids, gasses and multiphase fluids, and may be static control fluids, and/or fluids being produced from or injected in to the well.

Signals—General

Preferably the wireless signals are such that they are capable of passing through a barrier, such as a plug, when fixed in place. Preferably therefore the wireless signals are transmitted in at least one of the following forms: electromagnetic, acoustic, and inductively coupled tubulars.

EM/Acoustic and coded pressure pulsing use the well, borehole or formation as the medium of transmission. The EM/acoustic or pressure signal may be sent from the well, or from the surface. An EM/acoustic signal can travel through the barrier, although for certain embodiments, it may travel indirectly, for example around the barrier.

Electromagnetic and acoustic signals are especially preferred—they can transmit through/past an annular barrier without special inductively coupled tubulars infrastructure, and for data transmission, the amount of information that can be transmitted is normally higher compared to coded pressure pulsing, especially data from the well.

Therefore, the communication device may comprise an acoustic communication device and the wireless control signal comprises an acoustic control signal and/or the communication device may comprise an electromagnetic communication device and the wireless control signal comprises an electromagnetic control signal.

Similarly the transmitters and receivers used correspond with the type of wireless signals used. For example an acoustic transmitter and receiver are used if acoustic signals are used.

Where inductively coupled tubulars are used, there are normally at least ten, usually many more, individual lengths of inductively coupled tubular which are joined together in use, to form a string of inductively coupled tubulars. They have an integral wire and may be formed tubulars such as tubing, drill pipe or casing. At each connection between adjacent lengths there is an inductive coupling.

The inductively coupled tubulars that may be used can be provided by N O V under the brand Intellipipe®.

Thus, the EM/acoustic or pressure wireless signals can be conveyed a relatively long distance as wireless signals, sent for at least 200 m, optionally more than 400 m or longer which is a clear benefit over other short range signals. Embodiments including inductively coupled tubulars provide this advantage/effect by the combination of the integral wire and the inductive couplings. The distance travelled may be much longer, depending on the length of the well.

The control signal, and optionally other signals, may be sent in wireless form from above the barrier to below the barrier. Likewise signals may be sent from below the barrier to above the barrier in wireless form.

Data and commands within the signal may be relayed or transmitted by other means. Thus the wireless signals could be converted to other types of wireless or wired signals, and optionally relayed, by the same or by other means, such as hydraulic, electrical and fibre optic lines. In one embodiment, the signals may be transmitted through a cable for a first distance, such as over 400 m, and then transmitted via acoustic or EM communications for a smaller distance, such as 200 m. In another embodiment they are transmitted for 500 m using coded pressure pulsing and then 1000 m using a hydraulic line.

Thus whilst non-wireless means may be used to transmit the signal in addition to the wireless means, preferred configurations preferentially use wireless communication. Thus, whilst the distance travelled by the signal is dependent on the depth of the well, often the wireless signal, including relays but not including any non-wireless transmission, travel for more than 1000 m or more than 2000 m. Preferred embodiments also have signals transferred by wireless signals (including relays but not including non-wireless means) at least half the distance from the surface of the well to the apparatus.

Different wireless signals may be used in the same well for communications going from the well towards the surface, and for communications going from the surface into the well.

Thus, the wireless signal may be sent to the communication device, directly or indirectly, for example making use of in-well relays above and/or below the barrier. The wireless signal may be sent from the surface or from a wireline/coiled tubing (or tractor) run probe at any point in the well above the barrier. For certain embodiments, the probe may be positioned relatively close to the barrier for example less than 30 m therefrom, or less than 15 m.

Acoustic

Acoustic signals and communication may include transmission through vibration of the structure of the well including tubulars, casing, liner, drill pipe, drill collars, tubing, coil tubing, sucker rod, downhole tools; transmission via fluid (including through gas), including transmission through fluids in uncased sections of the well, within tubulars, and within annular spaces; transmission through static or flowing fluids; mechanical transmission through wireline, slickline or coiled rod; transmission through the earth; transmission through wellhead equipment. Communication through the structure and/or through the fluid are preferred.

Acoustic transmission may be at sub-sonic (<20 Hz), sonic (20 Hz-20 kHz), and ultrasonic frequencies (20 kHz-2 MHz). Preferably the acoustic transmission is sonic (20 Hz-20 khz).

The acoustic signals and communications may include Frequency Shift Keying (FSK) and/or Phase Shift Keying (PSK) modulation methods, and/or more advanced derivatives of these methods, such as Quadrature Phase Shift Keying (QPSK) or Quadrature Amplitude Modulation (QAM), and preferably incorporating Spread Spectrum Techniques. Typically they are adapted to automatically tune acoustic signalling frequencies and methods to suit well conditions.

The acoustic signals and communications may be unidirectional or bi-directional. Piezoelectric, moving coil transducer or magnetostrictive transducers may be used to send and/or receive the signal.

EM

Electromagnetic (EM) (sometimes referred to as Quasi-Static (QS)) wireless communication is normally in the frequency bands of: (selected based on propagation characteristics)

sub-ELF (extremely low frequency)<3 Hz (normally above 0.01 Hz);

ELF 3 Hz to 30 Hz;

SLF (super low frequency) 30 Hz to 300 Hz;

ULF (ultra low frequency) 300 Hz to 3 kHz; and,

VLF (very low frequency) 3 kHz to 30 kHz.

An exception to the above frequencies is EM communication using the pipe as a wave guide, particularly, but not exclusively when the pipe is gas filled, in which case frequencies from 30 kHz to 30 GHz may typically be used dependent on the pipe size, the fluid in the pipe, and the range of communication. The fluid in the pipe is preferably non-conductive. U.S. Pat. No. 5,831,549 describes a telemetry system involving gigahertz transmission in a gas filled tubular waveguide.

Sub-ELF and/or ELF are preferred for communications from a well to the surface (e.g. over a distance of above 100 m). For more local communications, for example less than 10 m, VLF is preferred. The nomenclature used for these ranges is defined by the International Telecommunication Union (ITU).

EM communications may include transmitting communication by one or more of the following: imposing a modulated current on an elongate member and using the earth as return; transmitting current in one tubular and providing a return path in a second tubular; use of a second well as part of a current path; near-field or far-field transmission; creating a current loop within a portion of the well metalwork in order to create a potential difference between the metalwork and earth; use of spaced contacts to create an electric dipole transmitter; use of a toroidal transformer to impose current in the well metalwork; use of an insulating sub; a coil antenna to create a modulated time varying magnetic field for local or through formation transmission; transmission within the well casing; use of the elongate member and earth as a coaxial transmission line; use of a tubular as a wave guide; transmission outwith the well casing.

Especially useful is imposing a modulated current on an elongate member and using the earth as return; creating a current loop within a portion of the well metalwork in order to create a potential difference between the metalwork and earth; use of spaced contacts to create an electric dipole transmitter; and use of a toroidal transformer to impose current in the well metalwork.

To control and direct current advantageously, a number of different techniques may be used. For example one or more of: use of an insulating coating or spacers on well tubulars; selection of well control fluids or cements within or outwith tubulars to electrically conduct with or insulate tubulars; use of a toroid of high magnetic permeability to create inductance and hence an impedance; use of an insulated wire, cable or insulated elongate conductor for part of the transmission path or antenna; use of a tubular as a circular waveguide, using SHF (3 GHz to 30 GHz) and UHF (300 MHz to 3 GHz) frequency bands.

Suitable means for receiving the transmitted signal are also provided, these may include detection of a current flow; detection of a potential difference; use of a dipole antenna; use of a coil antenna; use of a toroidal transformer; use of a Hall effect or similar magnetic field detector; use of sections of the well metalwork as part of a dipole antenna. Where the phrase "elongate member" is used, for the purposes of EM transmission, this could also mean any elongate electrical conductor including: liner; casing; tubing or tubular; coil tubing; sucker rod; wireline; drill pipe; slickline or coiled rod.

A means to communicate signals within a well with electrically conductive casing is disclosed in U.S. Pat. No. 5,394,141 by Soulier and U.S. Pat. No. 5,576,703 by MacLeod et al both of which are incorporated herein by reference in their entirety. A transmitter comprising oscillator and power amplifier is connected to spaced contacts at a first location inside the finite resistivity casing to form an electric dipole due to the potential difference created by the current flowing between the contacts as a primary load for the power amplifier. This potential difference creates an electric field external to the dipole which can be detected by either a second pair of spaced contacts and amplifier at a second location due to resulting current flow in the casing or alternatively at the surface between a wellhead and an earth reference electrode.

Relay

A relay comprises a transceiver (or receiver) which can receive a signal, and an amplifier which amplifies the signal for the transceiver (or a transmitter) to transmit it onwards.

There may be at least one relay. The at least one relay (and the transceivers or transmitters associated with the apparatus or at the surface) may be operable to transmit a signal for at least 200 m through the well. One or more relays may be configured to transmit for over 300 m, or over 400 m.

For acoustic communication there may be more than five, or more than ten relays, depending on the depth of the well and the position of the apparatus.

Generally, less relays are required for EM communications. For example, there may be only a single relay. Optionally therefore, an EM relay (and the transceivers or transmitters associated with the apparatus or at the surface) may be configured to transmit for over 500 m, or over 1000 m.

The transmission may be more inhibited in some areas of the well, for example when transmitting across a packer. In this case, the relayed signal may travel a shorter distance. However, where a plurality of acoustic relays are provided, preferably at least three are operable to transmit a signal for at least 200 m through the well.

For inductively coupled tubulars, a relay may also be provided, for example every 300-500 m in the well.

The relays may keep at least a proportion of the data for later retrieval in a suitable memory means.

Taking these factors into account, and also the nature of the well, the relays can therefore be spaced apart accordingly in the well.

The control signals may cause, in effect, immediate activation, or may be configured to activate the apparatus after a time delay, and/or if other conditions are present such as a particular pressure change.

Electronics

The apparatus may comprise at least one battery, optionally a rechargeable battery. The battery may be at least one of a high temperature battery, a lithium battery, a lithium oxyhalide battery, a lithium thionyl chloride battery, a lithium sulphuryl chloride battery, a lithium carbon-monofluoride battery, a lithium manganese dioxide battery, a lithium ion battery, a lithium alloy battery, a sodium battery, and a sodium alloy battery. High temperature batteries are those operable above 85° C. and sometimes above 100° C. The battery system may include a first battery and further reserve batteries which are enabled after an extended time in the well. Reserve batteries may comprise a battery where the electrolyte is retained in a reservoir and is combined with the anode and/or cathode when a voltage or usage threshold on the active battery is reached.

The control mechanism is normally an electronic control mechanism. The communication device is normally an electronic communication device.

The apparatus, especially the control mechanism, preferably comprises a microprocessor. Electronics in the apparatus, to power various components such as the microprocessor, control and communication systems, and optionally the valve, are preferably low power electronics. Low power electronics can incorporate features such as low voltage microcontrollers, and the use of 'sleep' modes where the majority of the electronic systems are powered off and a low frequency oscillator, such as a 10-100 kHz, for example 32 kHz, oscillator used to maintain system timing and 'wake-up' functions. Synchronised short range wireless (for example EM in the VLF range) communication techniques can be used between different components of the system to minimize the time that individual components need to be kept 'awake', and hence maximise 'sleep' time and power saving.

The low power electronics facilitates long term use of various components of the apparatus. The control mechanism may be configured to be controllable by the control signal up to more than 24 hours after being run into the well, optionally more than 7 days, more than 1 month, or more than 1 year or up to five years. It can be configured to remain dormant before and/or after being activated.

Tests

The method herein may be used to conduct pulse and/or interference tests.

The pressure changes may be caused by production, injection, perforating, closed chamber tests or other well tests in the first well. Normally they are caused by short or long term production. The pressure changes they cause may or may not be observed in the observing well.

Normally the well described herein is the observing well, where monitoring/observation occurs with the pressure sensor.

Deployment

The apparatus may be deployed with the barrier by being provided on the same string as the barrier and deployed into the well therewith. It may be retro-fitted into the well and moved past an annular seal. It is normally connected to a plug or hanger, and the plug or hanger in turn connected directly or indirectly, for example by tubulars, to the annular seal. The plug may be a bridge plug, wireline lock tubular/drill-pipe set barrier, shut-in tool or retainer such as a cement retainer. The plug may be a temporary or permanent plug.

Also, the apparatus may be provided in the well and then the barrier deployed and set thereabove and then the method described herein performed after the barrier is run in.

For certain embodiments, the apparatus may be deployed in a central bore of a pre-existing tubular in the well, rather than into a pre-existing annulus in the well. An annulus may be defined between the apparatus and the pre-existing tubular in the well.

The container, where present, may be sealed at the surface, and then deployed into the well. 'At surface' in this context is typically outside of the well although it could be sealed whilst in a shallow position in the well, such as up to 30 metres from the surface of the well, that is the top of the uppermost casing of the well. Thus the apparatus moves from the surface and is positioned below the barrier with the container sealed before activating the control device.

The aperture of the container may be provided within 100 m of a perforation between the well and the reservoir, optionally 50 m or 30 m. If there is more than one perforation, then the closest perforation is used to determine the spacing from the aperture of the apparatus. Optionally therefore, the aperture in the container may be spaced below perforations in the well. This can assist in drawing perforation debris away from the perforation(s) to help clear them.

A plurality of apparatus and optionally barriers described herein may be run on the same string, for example, spaced apart and positioned adjacent one section or isolated sections. Thus, the apparatus may be run in a well with multiple isolated sections adjacent different zones. In such a scenario, there may not be straightforward access below perforating devices to the lower zone(s). Thus when run with such a string, embodiments of the invention provide means to manipulate such a zone.

Miscellaneous

The well may be a subsea well. Wireless communications can be particularly useful in subsea wells because running cables in subsea wells is more difficult compared to land wells. The well may be a deviated or horizontal well, and embodiments of the present invention can be particularly suitable for such wells since they can avoid running wireline, cables or coiled tubing which may be difficult or not possible for such wells.

The well normally includes casing, though even if the barriers are set in a casing or liner, the perforating device may be adjacent to an openhole section of a well to enhance connectivity particularly where the pores in the formation may be at least partially blocked by filter cake. The barriers may thus be provided on casing, liner or (less usually) against a borehole. For certain embodiments the lower of the first and second barriers is provided on a liner, and the upper of the first and second barriers is provided on a casing.

Where the barriers are set in casing or liner, the cross-section of the well is defined by the cross-section of the casing or liner where the barrier is set. (In any case, there is normally cement between the casing/liner and the borehole). If the barriers are set in an openhole section the cross-section of the well is defined by the borehole. Where the barrier is spaced apart as two or more parts, the cross-section of the well is defined by the outer diameter of the part of the well with the outermost part of the barrier—the important feature being that the barrier isolates a section therebelow.

References herein to a perforating device includes perforating guns, punches or drills, all of which are used to create a perforation between the reservoir to the well.

The volume of the container is its fluid capacity.

Transceivers, which have transmitting functionality and receiving functionality; may be used in place of the transmitters and receivers described herein.

Unless indicated otherwise, any references herein to "blocked" or "unblocked" includes partially blocked and partially unblocked.

All pressures herein are absolute pressures unless stated otherwise.

The well is often an at least partially vertical well. Nevertheless, it can be a deviated or horizontal well. References such as "above" and below" when applied to deviated or horizontal wells should be construed as their equivalent in wells with some vertical orientation. For example, "above" is closer to the surface of the well through the well.

A zone is defined herein as a formation adjacent to or below the lowermost barriers, or a portion of the formation adjacent to the well which is isolated in part between barriers and which has, or will have, at least one communication path (for example perforation) between the well and the surrounding formation, between the barriers. Thus each additional barrier set in the well defines a separate zone, except areas between two barriers (for example a double barrier) where there is no communication path to the surrounding formation and none are intended to be formed.

"Kill fluid" is any fluid, sometimes referred to as "kill weight fluid", which is used to provide hydrostatic head typically sufficient to overcome reservoir pressure.

References herein to cement include cement substitute. A solidifying cement substitute may include epoxies and resins, or a non-solidifying cement substitute such as Sandaband™.

BRIEF DESCRIPTION OF THE DRAWINGS

Embodiments of the present invention will now be described by way of example only and with reference to the accompanying drawings, in which.

DETAILED DESCRIPTION

Figure 1:
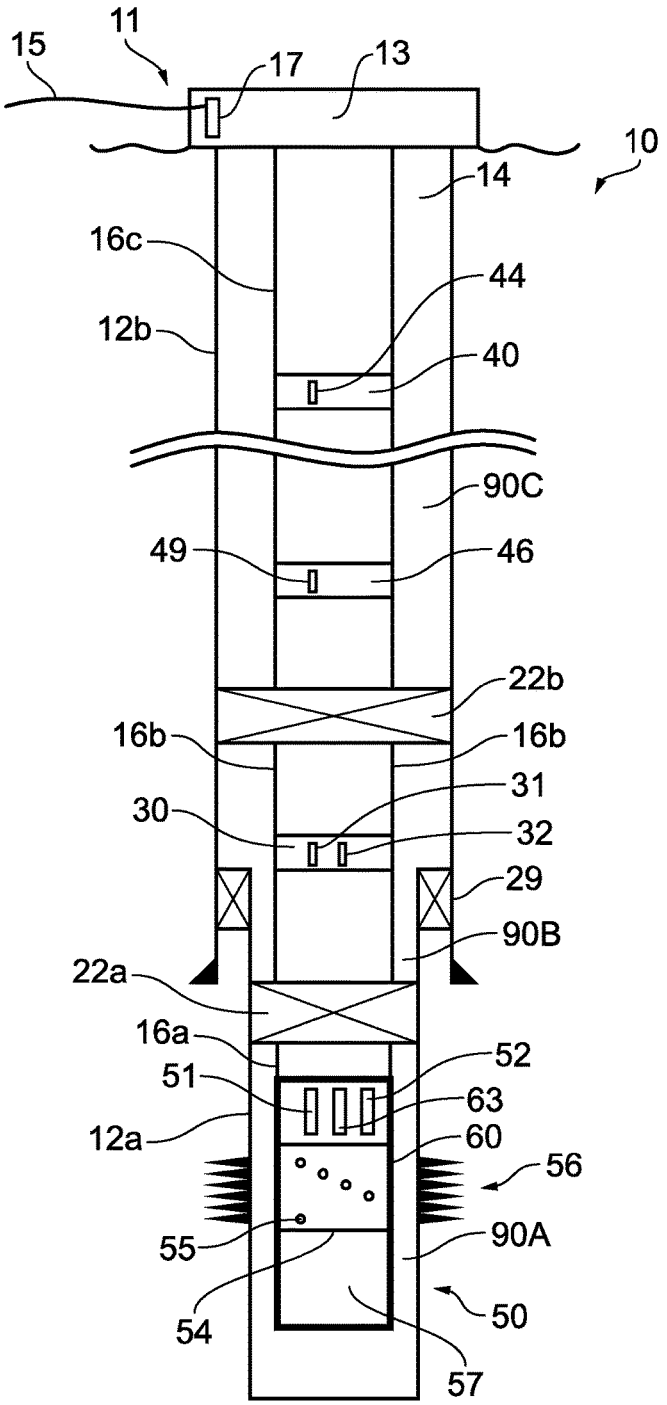
FIG. 1 is a diagrammatic sectional view of a first embodiment of a well and a well apparatus which may be used in a method of the present invention using acoustic signals.

FIG. 1 shows well apparatus 10 comprising an abandoned well 14, liner 12*a* and casing string 12*b*. Inside each of the liner 12*a* and casing string 12*b* there is an annulus 90A & 90C respectively and, between bridge plugs 22*a* & 22*b*, an annulus 90B. The well apparatus 10 further includes a liner hanger 29. The liner hanger 29 is part of a liner hanger assembly from which the liner 12*a* can be hung.

A string is provided in the well 14 and is divided into a lower tubular 16*a*, intermediate tubular 16*b*, and an upper tubular 16*c*. Bridge plugs 22*a* and 22*b* form barriers each across the entire cross-section of the well, and are set in liner 12*a* and casing string 12*b* respectively, expanding across the well 14 and splitting the well 14 into three sections. The upper 16*c*, intermediate 16*b* and lower tubulars 16*a*, provide a continuous physical connection in the well to facilitate acoustic communication. Whilst a variety of different options are feasible, the intermediate tubular 16*b* is more likely "stung in" or attached to the barrier 22*a*; whilst the tubulars 16*a* and 16*b* may be continuous and the barrier/bridge plug 22*b* formed from a packer element and a central plug.

Two instrument carriers 40 and 46 are provided on the upper tubular 16*c*. The instrument carriers 40 and 46 each comprise an acoustic relay 44, 49 respectively. A further instrument carrier 30 is provided on the intermediate tubular 16*b* between the bridge plugs 22*a*, 22*b*, and comprises pressure sensor 32 coupled to acoustic relay 31. The relays 44, 49 comprise transceivers which can receive control signals from the surface 11 and send it below the bridge plug 22*a* to a wireless transceiver (not shown) of an apparatus 50, optionally via the acoustic relay 31. Similarly the relays 44, 49 can receive data from below the bridge plugs 22*a* and 22*b*, and send it onwards, such as towards the surface of the well 11.

The surface of the well 11 comprises a cap 13 which covers the well 14. The cap 13 comprises a transceiver 17 coupled to a cable 15. The transceiver 17 is capable of converting the wired signals into acoustic signals for sending down the well 14 to acoustic relays 31, 44 & 49 or vice versa.

This embodiment of the well 14 comprises multiple sections. The first, upper section comprises the upper tubular 16*c*, the instrument carriers 40 & 46, and bridge plug 22*b*. The second, middle section comprises the intermediate tubular 16*b*, instrument carrier 30 and liner hanger 29. The third, lower section comprises the lower tubular 16*a*, lower bridge plug 22*a*, and the apparatus 50.

The apparatus 50 is located at the bottom of the lower tubular 16*a*, and comprises a monitoring mechanism 51 having a pressure sensor (not shown), a control mechanism comprising a gun controller 52 and a wireless transceiver (not shown), and a battery 63. The apparatus 50 also comprises a perforating gun 54 surrounded with an outer housing 60, and a hollow container 57 extending, co-linear, from the perforating gun 54.

The components of the control mechanism (the wireless transceiver and the gun controller 52) are normally provided adjacent each other, or close together; but may be spaced apart.

In use, before running the apparatus 50 into the well 14, the inside of the perforating gun 54 and the hollow container 57 are provided in pressure communication with each other, and sealed at atmospheric pressure at the surface, such that when the apparatus 50 is lowered into position in the well 14, they have a reduced pressure, i.e. they are underbalanced, with respect to the well 14. Shaped charges are provided within the perforating gun 54. In the first instance, the housing 60 of the perforating gun 54 is intact.

The apparatus 50 is run into the well 14 and the barrier set thereabove.

The perforating gun 54 is controlled by the gun controller 52. The wireless transceiver of the control mechanism is configured to receive an acoustic control signal from transceiver 17 of the cap 13, optionally via relays 31, 44 & 49. An operator sends a control signal to activate the perforating gun 54, via the cable 15 to the transceiver 17, where it is then sent acoustically down the well 14 to the wireless transceiver in the control mechanism.

The gun controller 52 then activates the perforating gun 54 in response to the control signal which causes the shaped charges to detonate and pierce through the liner 12*a*, thus creating perforations 56 in the liner 12*a*. In use, the detonation of the shaped charges creates apertures 55 in the housing 60 of the perforating gun 54. These apertures 55 allow fluid communication between the inside of the perforating gun 54/attached container 57, and an outside thereof. Thus in this embodiment, there is an underbalance of pressure between the inside of the perforating gun 54/container 57, and a surrounding portion of the well 14. The creation of apertures 55 causes a surge of fluid into the perforating gun 54/container 57 due the underbalance of pressure, thus clearing any debris in or around the apparatus 50 especially the perforations 56. (Debris' here and elsewhere can include perforating debris, filter cake, kill fluid, drilling mud and lost circulation material.)

The monitoring mechanism 51 including the pressure sensor monitors the well 14 which can be used to assess the nature of the reservoir. Moreover, activity on neighbouring wells can be monitored from the FIG. 1 well which can also be used to infer characteristics of the reservoir so that, for example, it may be exploited more appropriately.

Data from the monitoring mechanism 51 can be sent acoustically either continuously, or optionally periodically, to the top of the well 11, and then to the operator via wired cable 15 or alternatively, for a subsea well, via an underwater acoustic modem.

Thus in contrast to the known use of perforating guns in order to create flowpaths for production, in the present embodiment they are used during or after suspending or abandoning a well, below a barrier, in order to provide such monitoring functionality.

It is an advantage of embodiments of the present invention that clearing the debris in the perforations or surrounding formation allows data more representative of reservoir conditions to be gathered and sent to the surface.

In alternative embodiments, the perforating gun may be activated during the abandonment operation, that is, after setting a first barrier and prior to setting a second barrier.

The container 57 provides more volume to create a stronger "surge" effect. However alternative embodiments of the invention do not require a container and can rely on the underbalance effect using the inside of a perforating device. In an alternative modification to the FIG. 1 embodiment, the container may be removed, shortened or extended by removing or adding further lengths of tubing in order to create a smaller or larger drop in pressure when the shaped charges are fired.

For certain embodiments, the container may have a further aperture independent of the perforating gun which may be sealed by a valve for example, and such a valve controllable to open up to create a secondary surge from the container at a later time than the initial surge created by the inside of the perforating gun.

Alternative embodiments comprise only the lower tubular and the intermediate tubular and not the upper tubular, that is there is no tubular above the bridge plug 22*b*. In such embodiments, one option is to attach relays to the inside or outside of the casing string.

Figure 2:
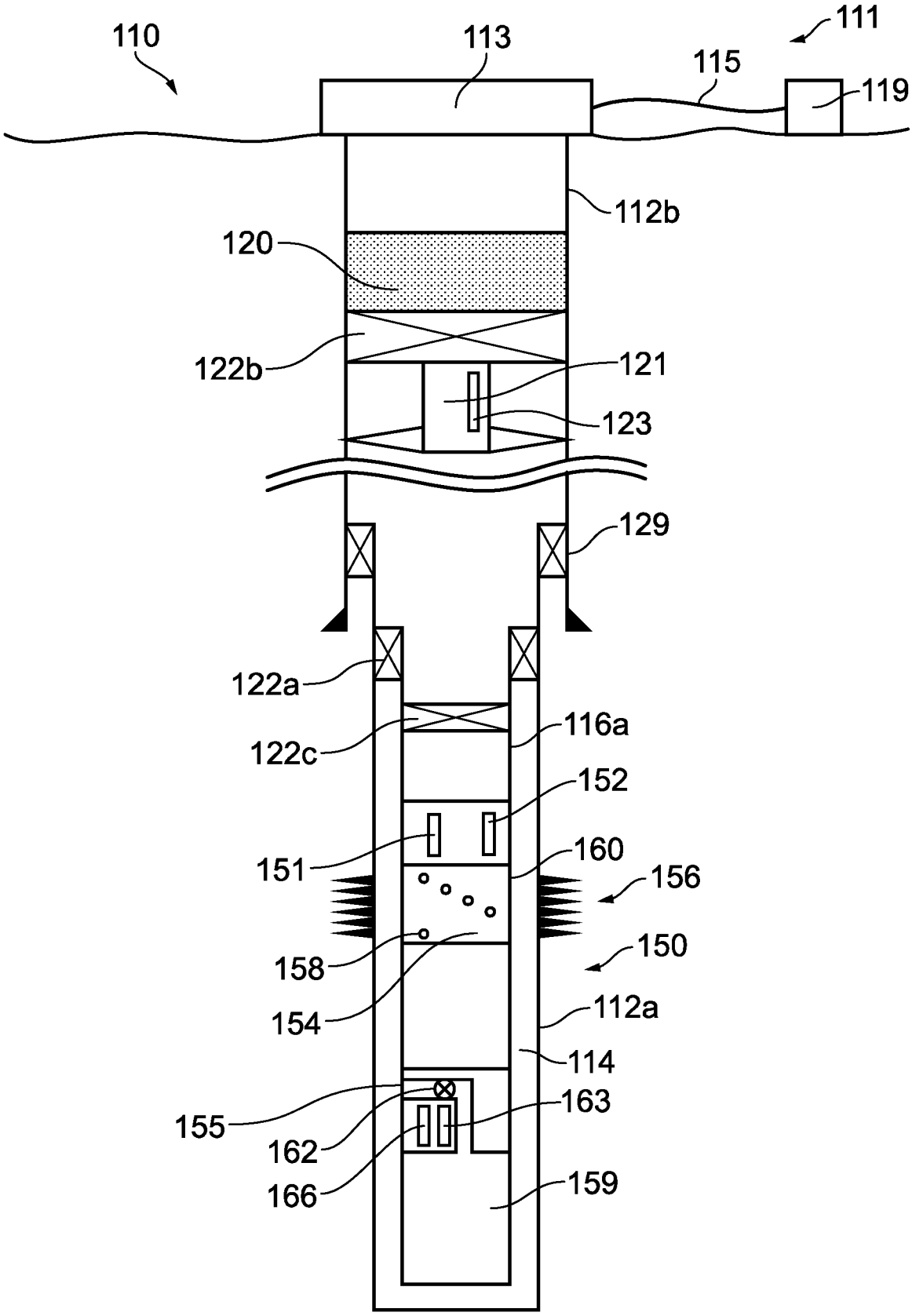
FIG. 2 is a diagrammatic sectional view of a second embodiment of a well and a well apparatus which may be used in accordance with a method of the present invention using electromagnetic signals.

FIG. 2 shows an embodiment of an apparatus 150 where activation of an underbalanced container is independent of perforating guns. Like parts with the FIG. 1 embodiment are not described in detail but are prefixed with a '1'. FIG. 2 shows an abandoned well 114 comprising packer 122*a*, two bridge plugs 122*b*, 122*c*, a cement seal 120 and a cap 113 at the top of the well 111. Compared to FIG. 1, FIG. 2 relies on electromagnetic communication and so comprises only a lower tubular 116*a*. Packer 122*a* seals the annulus at the top of the lower tubular 116*a*, and bridge plug 122*c* seals the bore near the top of the lower tubular 116*a*. Bridge plug 122*b* seals across the entire cross-section of the well, as do the combination of bridge plug 122*c* and packer 122*a*. Between bridge plugs 122*b* and 122*c*, and immediately below bridge plug 122*b*, there is provided an EM instrument carrier 121 comprising a transceiver 123.

A communications device 119 provides a contact spaced from the suspended or abandoned well 114 in order to transmit and receive electromagnetic signals. The communications device 119 is also capable of storing data for retrieval at a later date.

Similar to the FIG. 1 embodiment, the apparatus 150 comprises a perforating gun 154, a battery 163, a monitoring mechanism 151 with a pressure sensor (not shown). It also comprises control mechanisms, albeit for the valve as well as a separate control mechanism for the perforating gun, each control mechanism comprising a wireless transceiver (not shown) and a valve controller 166 and gun controller 152 respectively.

Shaped charges are provided within the perforating gun 154, and when activated create apertures 158.

However in contrast to FIG. 1, a container 159 is spaced below the perforating gun 154, at the end of the lower tubular 116*a*. The container 159 has an aperture 155, and a valve 162 controlling the aperture 155. Compared to FIG. 1, a second control mechanism comprising the valve controller 166 is provided to control the valve 162, along with a further wireless receiver (or transceiver) (not shown). The container 159 can have a volume capacity of, for example, 1000 litres.

Independent of the operation of the perforating gun 154, the valve 162 is configured to obstruct and isolate the aperture 155 to seal the container 159 from the surrounding portion of the well 114 in a closed position and allow pressure and fluid communication between a portion of the container 159 and the surrounding portion of the well 114 via the aperture 155 in an open position. In use, the valve 162 is moved from the closed position to the open position in response to a wireless control signal.

In some embodiments, the container 159 is filled with a gas, such as air, initially at atmospheric pressure. In such embodiments, the gas is sealed in the container 159 at the surface before being run into the well 114. This helps to create an underbalance of pressure, for example 1,000 psi to 10,000 psi, between the container 159 and the surrounding portion of the well 114 (which is at a higher pressure than atmospheric pressure on the surface).

After the perforating gun 154 has fired, as described above with respect to FIG. 1, the container 159 can be used to create a pressure surge into the container 159 to clear the debris in and around the perforations/formation before monitoring the well 114, or the adjacent reservoir.

In use, the valve 162 is initially in the closed position. An electromagnetic signal is sent to wireless transceiver (not shown) from an operator, optionally via transceiver 123. The gun controller 152 then activates the perforating gun 154 in response to the control signal such that the shaped charges are detonated and pierce through the housing 160 of the perforating gun 154, and also through the liner 112*a*, thus creating perforations 156 in the liner 112*a*. An electromagnetic signal is then sent, optionally at an earlier or much later time, to the further transceiver instructing the valve controller 166 to open the valve 162 controlling an aperture 155. The underbalance of pressure in the container 159 causes a surge of fluid into the container 159 via the aperture 155.

Once the well 114 is more clear of debris, the monitoring mechanism 151 can then more effectively monitor the reservoir, or optionally monitor the effect on the reservoir of activity on other wells linked to the reservoir and can communicate the data electromagnetically to the top of the well 111. The cable 115 and communication box 119 form a spaced contact to detect and transmit electromagnetic signals, and the communication box 119 is used as an interface to a local or remote data acquisition and control system.

In some embodiments, the container may be overbalanced, or have an overbalance portion, that is an area of increased pressure compared to a surrounding portion of the well. In such embodiments, once a valve is opened, there is a surge of fluid from the container into the surrounding portion of the well. The apparatus is particularly suited in this case to deploying acid for an acid treatment. The container may be filled with hydrochloric acid or other acids or chemicals used for such so-called acid treatments. Acid wash normally treats the face of the wellbore, or may treat scale within a wellbore, or it may be performed to try to mitigate perforation debris or other skin damage. Acids may be directed towards specific areas, for example by using openings in a tube. The aperture may comprise a tube extending along the wellbore with a plurality of openings. The acid treatment may then pass along the tube and exit into the well at the appropriate location. The overbalanced container may be used instead of an underbalanced container. Alternatively a pressure balanced container comprising a pump may be used to deploy the acid treatment instead of an overbalanced container. Additionally a discrete temperature array (not shown) may be used across the perforation gun to monitor the acid treatment and reservoir.

In some embodiments, the valve can also be opened before activating the perforating device. Optionally, the same container is used to clear the well of debris both before and after activating the perforating devices, but in some embodiments there may be more than one container, or more than one chamber within a container. For example, one container/chamber may be used to clear the well before the perforating device is activated, and the second used after.

For certain embodiments, the valve may be opened immediately after the perforating guns have activated. In other embodiments, the opening of the valve may be delayed for some time after the perforating gun has fired. Likewise, the activation of the perforating guns may be delayed after the barrier is set. It may, for example, be activated immediately prior to testing an adjacent well. The activation of the perforating guns could also occur after the rig connected to the well has been removed.

In some alternative embodiments, one or a first group of shaped charges provided in the perforating gun may be detonated before a second or second group of shaped charges. Further embodiments may have multiple perforating guns, where each perforating gun may be separated by a barrier, such as a bridge plug or a packer.

Figure 3:
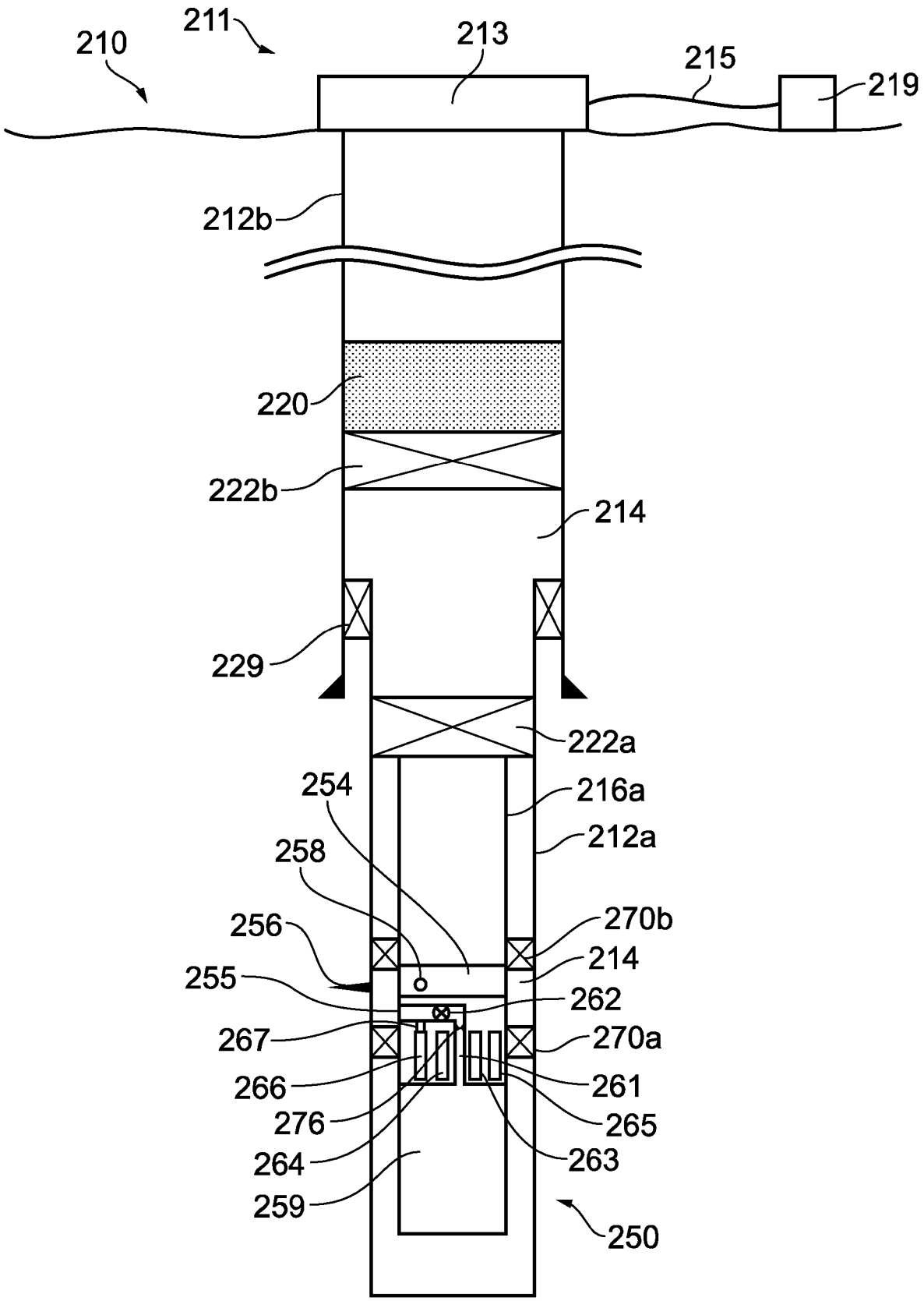
FIG. 3 is a diagrammatic sectional view of a third embodiment of a well and a well apparatus used for a short interval test in accordance with a method of the present invention.

FIG. 3 shows a further embodiment of the apparatus 250. Like parts with the FIG. 2 embodiment are not described in detail but are prefixed with a '2'. FIG. 3 shows an abandoned well 214 comprising two bridge plugs 222*a* & 222*b*, and two packer elements 270*a* & 270*b* between a lower tubular 216*a* and a liner 212*a*. The two packer elements 270*a*, 270*b* are spaced apart along the well 214 and define a short interval. Like the embodiment described in FIG. 2, FIG. 3 relies on electromagnetic communication.

The apparatus 250 in FIG. 3 comprises a valve 262, a choke 276, an aperture 255, a control mechanism with a wireless receiver or transceiver (not shown) and multi-purpose controller 266; a battery 263, a monitoring mechanism 265 with a pressure sensor, and a container 259 which can have a volume capacity of, for example, 100 litres. There is an underbalance of pressure between the container 259 and a surrounding portion of a well 214 within the short interval between packer elements 270*a* and 270*b*.

The battery 263 powers the components of the apparatus 250, for example the multi-purpose controller 266, the monitoring mechanism 265 and the transceiver. Often a separate battery is provided for each powered component. In alternative embodiments, downhole power generation may be used, for example, by thermoelectric generation.

The choke 276 is located adjacent to the valve 262, optionally spaced apart from the valve, in a passageway 261 between the aperture 255 and the container 259. The rate at which fluid enters the container 259 is controlled by the cross-sectional area of the choke 276. In alternative embodiments, the choke 276 and valve 262 positions can be in the opposite order to that illustrated, or they may be combined into a single component.

Compared to the FIG. 1 and FIG. 2 embodiments, the FIG. 3 embodiment comprises a punch gun 254 with a single aperture 258 which in use, creates a single perforation 256 in the liner 212*a*. In contrast to FIG. 2, the punch gun 254 and the valve 262 of FIG. 3 are both controllable by the same multi-purpose controller 266 and the same wireless transceiver.

The aperture 255 of the container 259 is located within the short interval between the packer elements 270*a* and 270*b*. The punch gun 254 is also located within the short interval, such that in use the punch gun 254 activates and creates the single perforation 256 within the short interval to allow fluid communication between the reservoir (not shown) and the surrounding portion of the well 214 within the short interval.

The well may be manipulated by conducting a flow test, whereby flow from the reservoir is produced into said defined short interval, and proceeds through the apparatus. In use, the packer elements 270*a* and 270*b* are initially set in the liner 212*a* to define the short interval for testing. The multi-purpose controller 266 then receives an electromagnetic control signal to activate the punch gun 254 which creates perforation 256 in the liner 212*a* and adjacent formation (not shown) to allow fluid communication between the formation and the surrounding portion of the well 214 in the short interval.

The multi-purpose controller 266 then receives a further electromagnetic control signal to open the valve 262. The container 259, which is underbalanced, can then receive flow in a controlled manner from the perforated interval between the two packer elements 270*a* and 270*b*.

The debris in or around the perforation 256 is also drawn into the container 259 due to this underbalance of pressure, thus helping to clear the surrounding portion of the well 214 in the short interval. The underbalance effect is concentrated in the short interval thus extends the radius of the reservoir upon which it acts. This can help to improve well flow and allow more accurate data to be obtained from the flow test.

Pressure is monitored by the monitoring mechanism 265 both before the valve 262 is opened and as the flow enters the container 259 at a rate controlled by the choke 276.

The valve 262 is closed before significant pressure builds up in the container 259. A relatively limited flow test can thus be conducted in the short interval between the packer elements 270*a* and 270*b*. Data from the monitoring mechanism 265 or other sensors in communication with the short interval, such as between the two packer elements 270*a*, 270*b* or below the lower packer element 270*a* in the passageway 261 adjacent to the choke 276, can provide useful flow test information. The response of the reservoir to the flow test and build-up can elicit useful information on the reservoir characteristics.

It is an advantage of certain embodiments of the present invention that the short interval flow tests may be conducted with barrier(s), such as bridge plugs and packers, in place as this may help to increase the safety of the well. The barrier(s) may also allow the short interval tests to be carried out concurrently with other well activities and operations which are occurring above the barrier(s). This can save rig time.

In some embodiments, after the liner has been perforated the well may be monitored for a short period of time, for example the well may flow at a low rate for up to 24 hours into the container. In some embodiments, the well may be monitored whilst the well above the barrier is being abandoned.

A variety of alternatives are available for such a flow test of a short interval. Two or more such flow tests can be conducted. In one embodiment, the valve 262 can be opened again and further fluid can enter the container 259. This open/close sequence can be repeated until the container 259 is full. Alternatively or additionally, further underbalanced containers may be provided to conduct the further flow test(s).

As a further option, a second underbalanced container is provided which can be used to purge the short interval, before the apparatus 250 is used to conduct the flow test on the short interval, as described above.

In some embodiments, the container 259 or additional containers may have an overbalance of pressure compared to the surrounding portion of the well 214 in the short interval. In such embodiments, the apparatus may be used to conduct an interval injectivity, permeability, well/reservoir treatment, hydraulic fracturing, minfrac or similar test/procedure which may require pressure to be applied between two annular sealing devices, such as between the packer elements 270*a* and 270*b* defining a short interval. A similar effect can be achieved by a pump instead of a pressurised container. In any case, the effect is concentrated in the short interval and thus penetrates the formation more.

In alternative embodiments, a short gun may be used instead of a punch gun.

Figure 4:
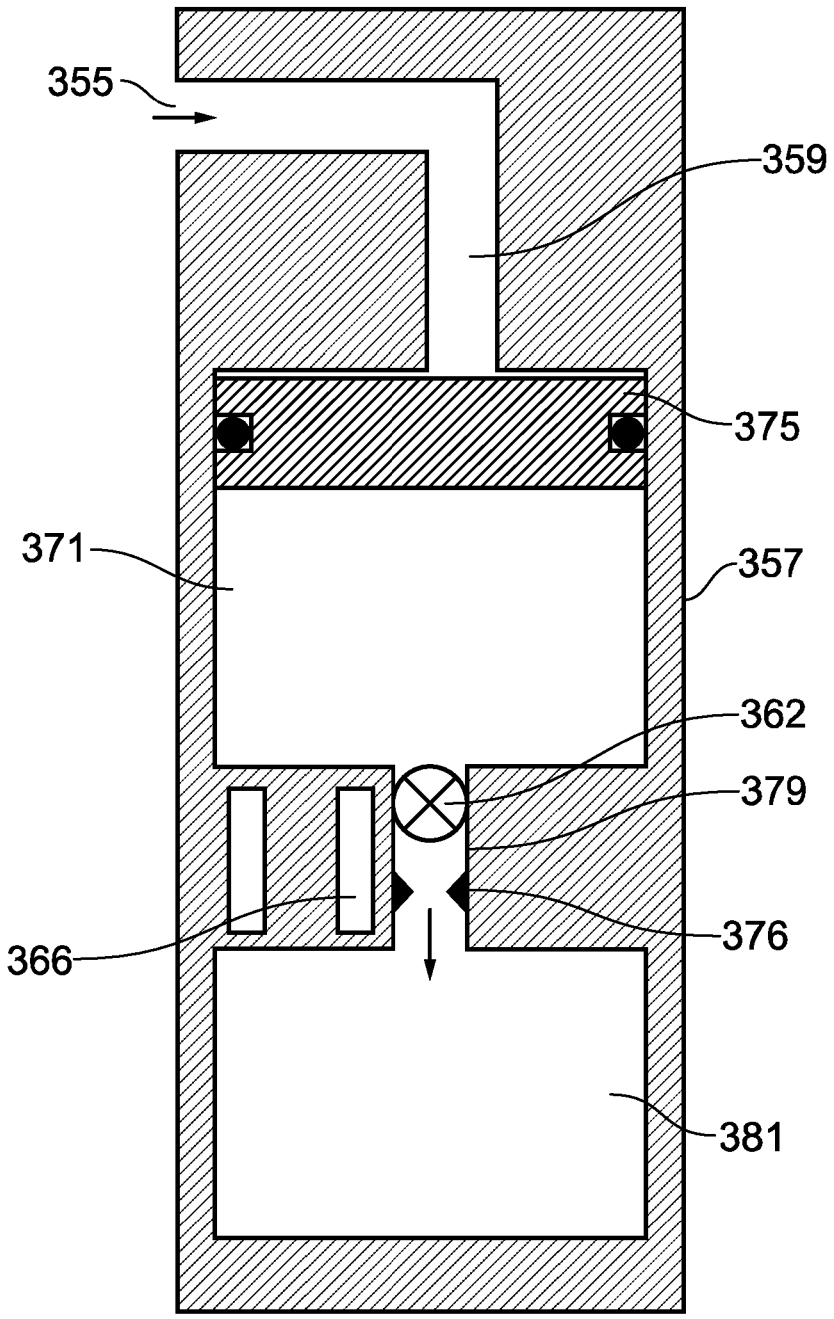
FIG. 4 is a schematic view of a container with a floating piston used in certain embodiments.

A particularly suitable apparatus for FIG. 3 applications is shown in FIG. 4. The FIG. 4 apparatus comprises an aperture 355, a valve 362, a choke 376 and a control mechanism with a multi-purpose controller 366 and a wireless receiver (or transceiver) (not shown); and a container 357. The valve 362 and the choke 376 are located in a central portion of the apparatus in an aperture 379 between two sections of the container 357—a fluid chamber 371 and a dump chamber 381.

A floating piston 375 is located in the fluid chamber 371. The fluid chamber 371 is initially filled with oil below the floating piston 375 through a fill aperture (not shown). When the floating piston 375 is located at the top of the fluid chamber 371 it isolates/closes the fluid chamber 371 from the surrounding portion of the well, and when the floating piston 375 moves towards the bottom of the fluid chamber 371 the opening 355 allows fluid to enter the fluid chamber 371 via flow aperture 359 from outside of the container, normally the surrounding portion of the well. The location of the floating piston 375 is controlled indirectly by the flow of fluid through the valve 362, which is in turn controlled via signals sent to the multi-purpose controller 366.

In use, the sequence begins with the valve 362 in the closed position and the floating piston 375 located towards the top of the fluid chamber 371. Fluid in the well is resisted from entering the fluid chamber 371 via the aperture 355 by the floating piston 375 and oil therebelow whilst the valve 362 is in the closed position. A signal is then sent to the multi-purpose controller 366 instructing the valve 362 to open. Once the valve 362 opens, oil from the fluid chamber 371 is directed into the dump chamber 381 by the well pressure acting on the floating piston 375, and fluids from the surrounding portion of the well are drawn into the fluid chamber 371. The rate at which the oil in the fluid chamber 371 is expelled into the dump chamber 381, and consequentially the rate at which the fluids from the well can be drawn into the container 357, is controlled by the cross-sectional area of the choke 376.

Alternatively, a pump may be used instead of the underbalanced pressure in the container in order to draw fluids into the container.

It is an advantage of the FIG. 4 embodiment that the floating piston and choke can help to control the rate of flow of well fluids and debris from the surrounding portion of the well into the container, which may allow more accurate data to be obtained and therefore better analysis of the well and reservoir can be carried out.

Modifications and improvements can be incorporated without departing from the scope of the invention. For example, the features of FIG. 1 and FIG. 2 may be combined such that the apparatus may comprise more than one underbalanced container, and the control signals may be transmitted acoustically and/or electromagnetically. Similarly, the FIG. 3 embodiment may rely on acoustic communication instead of or in addition to electromagnetic communication.

Moreover, the figures show the well in a suspended state. Before the stage shown in the figures a rig may be connected to the well which is not covered by a cap. A first barrier could be set and then a perforating device activated whilst the rig is still present and before a second barrier is set. After these steps, the second barrier would be set, and subsequently the connection with the rig removed and a cap put in place.

That claimed is:

1. A method of monitoring a reservoir comprising:

in a well with a cross-section, setting at least one barrier in the well, such that pressure and fluid communication are resisted across the entire cross-section of the well thus separating the well into a lower isolated section below the at least one barrier and an upper section above the at least one barrier;

wherein there is provided an apparatus in the lower isolated section, including:

a perforating device;

a control mechanism to control the perforating device, and comprising a wireless communication device configured to receive a wireless control signal for activating the perforating device;

a pressure sensor;

sending a wireless control signal to the wireless communication device to activate the perforating device, the wireless control signal transmitted in at least one of the following forms: electromagnetic, acoustic, inductively coupled tubulars and coded pressure pulsing;

after the at least one barrier is set, activating the perforating device, in order to create at least one perforation between the well and a surrounding reservoir;

during or after the at least one barrier is set, at least one of suspending and abandoning at least a zone adjacent said lower isolated section;

after the perforating device has been activated and after said zone has been at least one of suspended and abandoned:

(i) monitoring the pressure in the lower isolated section below the at least one barrier using the pressure sensor; and (ii) sending a wireless data signal including pressure data from below the at least one barrier to above the at least one barrier, using at least one of electromagnetic communication, acoustic communication and inductively coupled tubulars.

2. A method as claimed in claim 1, wherein the method includes monitoring for pressure changes caused by actions in a further well.

3. A method as claimed in claim 1, wherein the at least one barrier is set before the wireless control signal is sent to the wireless communication device, such that the wireless control signal is sent from above the at least one barrier to the wireless communication device below the at least one barrier to activate the perforating device.

4. A method as claimed in claim 1, wherein the perforating device is activated less than a week after the at least one barrier has been set.

5. A method as claimed in claim 1, wherein the at least one barrier comprises one of a bridge plug and a plugged packer.

6. A method as claimed in claim 1, wherein the at least one barrier is formed from a central portion and an annular portion and the central portion is one of at, and below, the annular portion.

7. A method as claimed in claim 1, wherein the at least one barrier includes one of a column of cement, and a cement like material, having a height of at least 2 m.

8. A method as claimed in claim 1, wherein the entire well is at least one of suspended and abandoned.

9. A method as claimed in claim 1, wherein the at least one barrier is a first barrier and at least one second barrier is set above the apparatus, such that the at least one second barrier resists pressure and fluid communication across the entire cross-section of the well, thus isolating a section of the well therebelow and wherein, optionally, the perforating device is activated after the at least one second barrier is set.

10. A method as claimed in claim 1, wherein the apparatus includes a container, and the method includes causing fluid movement through an aperture between an inside and an outside of the container.

11. A method as claimed in claim 10, wherein immediately before fluid movement through the aperture, the pressure inside at least a portion of the container is one of at least 500 psi lower, and at least 500 psi higher, than the pressure outside the container.

12. A method as claimed in claim 10, wherein the aperture is a pre-existing aperture in the container, and a wirelessly controlled control device one of allows and resists fluid movement between the inside and the outside of the container via the aperture.

13. A method as claimed in claim 10, wherein the container has a volume of one of at least 5 l, and at least 50 l, optionally at least 100 l.

14. A method as claimed in claim 10, wherein the container is sealed at the surface, and then deployed into the well such that the apparatus moves from the surface into the well with the container sealed.

15. A method as claimed in claim 10, wherein the aperture is between a first portion of a packer element and a second portion of a packer element, and a perforation is created between the reservoir and the well also between the two portions of the packer element(s), and a short interval test is performed.

16. A method as claimed in claim 15, wherein the portions of the packer element are less than 10 m apart.

17. A method as claimed in claim 1, wherein fluids which are lighter than well fluids are circulated in the well to reduce the hydrostatic head in the well, optionally to a pressure lower than the reservoir pressure, and the at least one barrier is set whilst the hydrostatic head in the well is reduced.

18. A method as claimed in claim 1, including using the apparatus to conduct a drawdown test, flow test, build-up test, connectivity tests, an interval injectivity test and a pressure test.

19. A method as claimed in claim 1, wherein one of (i) an array of discrete temperature sensors, and (ii) a distributed temperature sensor, is provided below the at least one barrier.

20. A method as claimed in claim 1, wherein at least one of the wireless data signal and wireless control signal is transmitted in at least one of electromagnetic signals and acoustic signals.

* * * * *